US012692870B2

(12) United States Patent
Nakatsuji et al.

(10) Patent No.: US 12,692,870 B2
(45) Date of Patent: Jul. 28, 2026

(54) VACUUM PUMP

(71) Applicant: Edwards Japan Limited, Yachiyo (JP)

(72) Inventors: Shigeyoshi Nakatsuji, Yachiyo (JP); Yoshiyuki Takai, Yachiyo (JP); Haruki Suzuki, Yachiyo (JP)

(73) Assignee: Edwards Japan Limited, Yachiyo (JP)

( * ) Notice: Subject to any disclaimer, the term of this patent is extended or adjusted under 35 U.S.C. 154(b) by 0 days.

(21) Appl. No.: 18/254,581

(22) PCT Filed: Dec. 3, 2021

(86) PCT No.: PCT/JP2021/044570
§ 371 (c)(1),
(2) Date: May 25, 2023

(87) PCT Pub. No.: WO2022/131035
PCT Pub. Date: Jun. 23, 2022

(65) Prior Publication Data

US 2024/0026889 A1 Jan. 25, 2024

(30) Foreign Application Priority Data

Dec. 14, 2020 (JP) ..... 2020-206436
Mar. 4, 2021 (JP) ..... 2021-034164

(51) Int. Cl.
*F04D 19/04* (2006.01)
*F04D 29/58* (2006.01)

(52) U.S. Cl.
CPC ..... *F04D 19/042* (2013.01); *F04D 19/048* (2013.01); *F04D 29/5853* (2013.01)

(58) Field of Classification Search
CPC ..... F04D 19/042; F04D 19/044; F04D 19/046
See application file for complete search history.

(56) References Cited

U.S. PATENT DOCUMENTS 5,536,148 A * 7/1996 Nishiuchi ..... F04D 29/662 417/424.2
2002/0039533 A1 4/2002 Miyamoto
(Continued)

FOREIGN PATENT DOCUMENTS

CN 105358835 A 2/2016
CN 106415020 A 2/2017
(Continued)

OTHER PUBLICATIONS

International Search Report and Written Opinion of International Application No. PCT/JP2021/044570 dated Feb. 1, 2022, 9 Pages.
(Continued)

*Primary Examiner* — Brian O Peters
(74) *Attorney, Agent, or Firm* — Shumaker & Sieffert, P.A.

(57) ABSTRACT

There is obtained a vacuum pump which suppresses an influence on external piping caused by a contact failure of a rotor during rotation of the rotor. A temperature rise ring 301 is provided in the vacuum pump, an outlet port 133 to which the external piping is connected is connected to the temperature rise ring 301, and a rotational force is directly or indirectly applied to the temperature rise ring 301 due to the contact failure of the rotor during the rotation of the rotor. In addition, a rotation suppression means (a hole 301*a* and a bolt 305) for suppressing rotation of the temperature rise ring 301 by the above-described rotational force is provided separately from a connection portion between the temperature rise ring 301 and a casing (outer tube 127*a*).

7 Claims, 9 Drawing Sheets

(56) References Cited

U.S. PATENT DOCUMENTS

| | | | | |
|---|---|---|---|---|
| 2016/0160877 | A1 | 6/2016 | Sakaguchi | |
| 2017/0002832 | A1* | 1/2017 | Nonaka | F04D 29/545 |
| 2021/0010479 | A1 | 1/2021 | Miwata et al. | |

FOREIGN PATENT DOCUMENTS

| | | | |
|---|---|---|---|
| EP | 3193430 | A1 | 7/2017 |
| JP | H1089274 | A | 4/1998 |
| JP | 2010031678 | A | 2/2010 |
| JP | 2017127145 | A | 7/2017 |
| JP | 2019090384 | A | 6/2019 |
| JP | 2019090398 | A | 6/2019 |
| JP | 2019178655 | A | 10/2019 |

OTHER PUBLICATIONS

Office Action from counterpart Japanese Application No. 2021-034164 dated Feb. 12, 2025, 6 pp.

First Office Action and Search Report, and translation thereof, from counterpart CN Application No. 202180075713.2 dated Mar. 11, 2026, 13 pp.

* cited by examiner

VACUUM PUMP

This application is a U.S. national phase application under 35 U.S.C. § 371 of international application number PCT/JP2021/044570 filed on Dec. 3, 2021, which claims the benefit of JP application number 2020-206436 filed on Dec. 14, 2020 and JP application number 2021-034164 filed on Mar. 4, 2021. The entire contents of each of international application number PCT/JP2021/044570, JP application number 2020-206436, and JP application number 2021-034164 are incorporated herein by reference.

TECHNICAL FIELD

The present disclosure relates to a vacuum pump.

BACKGROUND

A vacuum pump such as a turbo-molecular pump includes a rotor, which is caused to rotate by a motor, and a stator, which is disposed around the rotor and forms a flow path with the rotor, and causes a gas molecule which enters from an inlet port to collide with a rotor blade of the rotor and a stator blade of the stator and transfers the gas molecule toward an outlet port.

A certain vacuum pump further includes an annular member which raises a temperature of a stator side in order to suppress, for instance, a gaseous reaction material or a reaction product from being adhered to or being precipitated on, and then being deposited on a wall surface in a flow path, and an outlet port is connected to the annular member.

SUMMARY

When a failure in which the rotor comes into contact with a stator member such as the stator due to the above-described deposit or the like occurs during rotation of the rotor, a rotational force is applied to the stator member itself and the above-described annular member coupled to the stator member by the rotational force of the rotor, and the rotational force is also applied to the outlet port connected to the annular member. In addition, during operation of the vacuum pump, external piping is connected to the outlet port and the external piping is fixed to an external structure or device, and hence, at the time of such a failure, the rotational force is also applied to the external piping, and there is a possibility that a failure such as displacement, deformation, or disconnection may occur in the external piping.

Such a problem is not limited to the above-described outlet port, and there is a possibility that the problem may occur similarly in other piping connection portions connected to the annular member to which the rotational force is applied directly or indirectly at the time of a contact failure of the rotor.

The present disclosure has been made in view of the above problem, and an object thereof is to obtain a vacuum pump which suppresses an influence on external piping caused by a contact failure of a rotor during rotation of the rotor.

A vacuum pump according to the present disclosure includes: a rotor; a stator; a casing which houses the rotor and the stator; an annular member to which a rotational force is directly or indirectly applied due to a contact failure of the rotor during rotation of the rotor; a piping connection portion which is connected to the annular member and to which external piping is connected; and a rotation suppression means for suppressing rotation of the annular member by the above-described rotational force separately from a connection portion between the annular member and the casing.

According to the present disclosure, there is obtained the vacuum pump which suppresses the influence on the external piping caused by the contact failure of the rotor during the rotation of the rotor.

The above and other objects, features, and advantages of the present disclosure will be more apparent from the following detailed description with the accompanying drawings.

DETAILED DESCRIPTION

Hereinbelow, examples of the present disclosure will be described based on the drawings.

Figure 1:
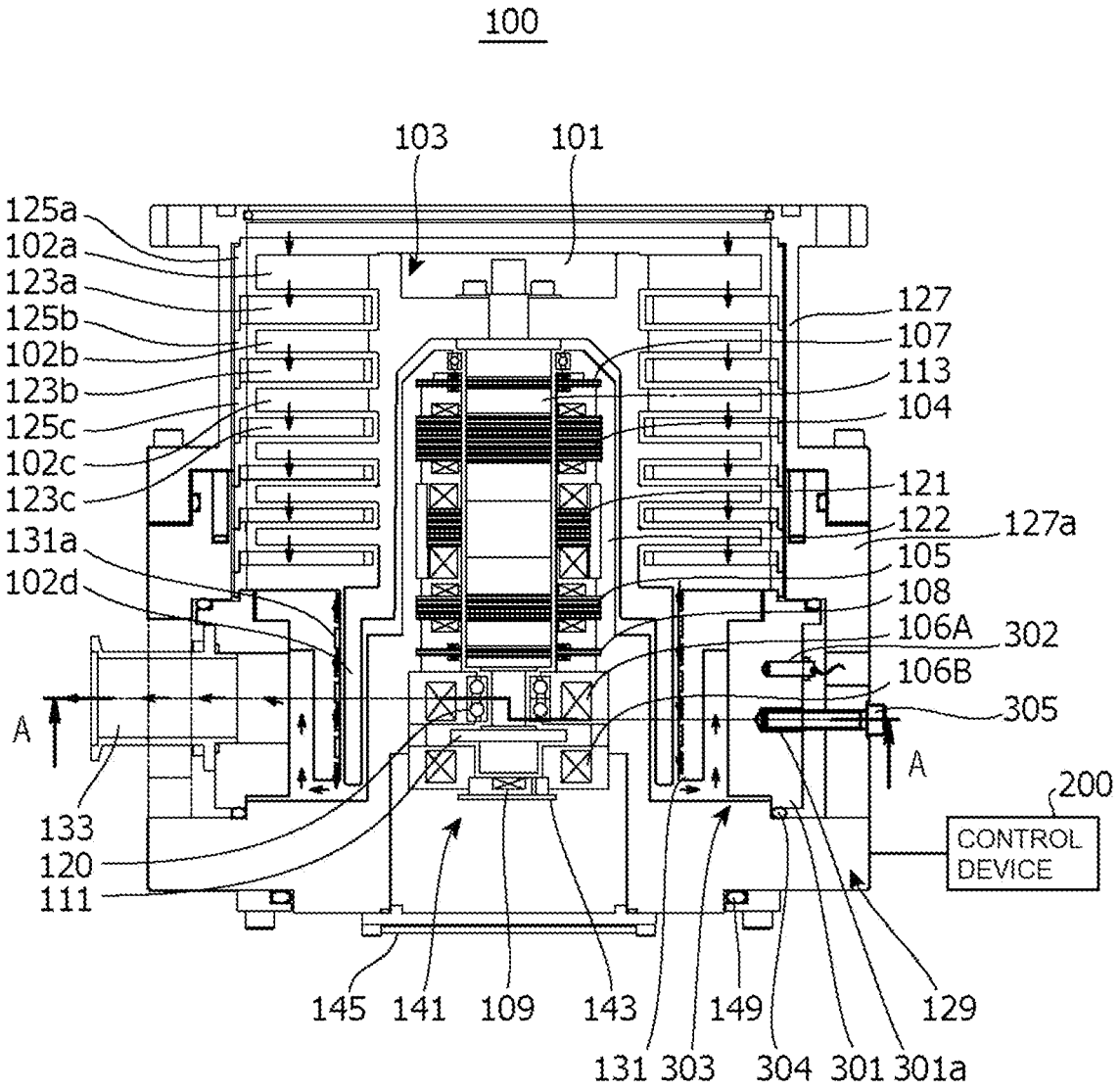
FIG. 1 is a longitudinal sectional view showing a turbo-molecular pump serving as a vacuum pump according to Example 1 of the present disclosure.

FIG. 1 shows a longitudinal sectional view of this turbo-molecular pump 100. In FIG. 1, in the turbo-molecular pump 100, an inlet port 101 is formed at an upper end of a cylindrical outer tube 127. In addition, inside the outer tube 127, a rotating body 103 in which a plurality of rotor blades 102 (102*a*, 102*b*, 102*c* . . . ) which are turbine blades for sucking and exhausting gas are formed radially in multiple tiers in a peripheral portion is provided. A rotor shaft 113 is attached to the center of the rotating body 103, and the rotor shaft 113 is supported so as to be levitated in the air by, e.g., a five-axis control magnetic bearing and a position of the rotor shaft 113 is controlled also by the five-axis control magnetic bearing. In general, the rotating body 103 is constituted by a metal such as aluminum or an aluminum alloy.

Upper radial electromagnets 104 are disposed such that four electromagnets are paired in an X-axis and a Y-axis. Four upper radial sensors 107 are provided so as to be close to the upper radial electromagnets 104 and correspond to the individual upper radial electromagnets 104. As the upper radial sensor 107, an inductance sensor having, e.g., a conductive winding or an eddy current sensor is used, and the upper radial sensor 107 detects a position of the rotor shaft 113 based on change of inductance of the conductive winding which changes according to the position of the rotor shaft 113. The upper radial sensor 107 is configured to detect a radial displacement of the rotor shaft 113, i.e., the rotating body 103 fixed to the rotor shaft 113, and send the radial displacement thereof to a control device 200.

In the control device 200, for example, a compensation circuit having a PID adjustment function generates an excitation control command signal of the upper radial electromagnet 104 based on a position signal detected by the upper radial sensor 107, and an amplifier circuit 150 (described later) shown in FIG. 2 performs excitation control on the upper radial electromagnet 104 based on the excitation control command signal, whereby an upper radial position of the rotor shaft 113 is adjusted.

The rotor shaft 113 is formed of a high-permeability material (iron, stainless steel, or the like), and is attracted by magnetic force of the upper radial electromagnet 104. Such adjustment is performed in an X-axis direction and in a Y-axis direction independently. In addition, a lower radial electromagnet 105 and a lower radial sensor 108 are disposed similarly to the upper radial electromagnet 104 and the upper radial sensor 107, and adjust a lower radial position of the rotor shaft 113 similarly to the upper radial position.

Further, axial electromagnets 106A and 106B are disposed so as to vertically sandwich a disc-shaped metal disc 111 provided below the rotor shaft 113. The metal disc 111 is constituted by a high-permeability material such as iron. A configuration is adopted in which an axial sensor 109 is provided for detecting an axial displacement of the rotor shaft 113, and an axial position signal is sent to the control device 200.

In the control device 200, for example, the compensation circuit having the PID adjustment function generates an excitation control command signal of each of the axial electromagnet 106A and the axial electromagnet 106B based on the axial position signal detected by the axial sensor 109, and the amplifier circuit 150 performs excitation control on each of the axial electromagnet 106A and the axial electromagnet 106B based on the excitation control command signals, whereby the axial electromagnet 106A attracts the metal disc 111 upward with magnetic force, the axial electromagnet 106B attracts the metal disc 111 downward, and an axial position of the rotor shaft 113 is thereby adjusted.

Thus, the control device 200 properly adjusts the magnetic force exerted on the metal disc 111 by the axial electromagnets 106A and 106B to magnetically levitate the rotor shaft 113 in an axial direction and hold the rotor shaft 113 in space in a non-contact manner. Note that the amplifier circuit 150 which performs the excitation control on the upper radial electromagnets 104, the lower radial electromagnet 105, and the axial electromagnets 106A and 106B will be described later.

On the other hand, a motor 121 includes a plurality of magnetic poles which are disposed circumferentially so as to surround the rotor shaft 113. Each magnetic pole is controlled by the control device 200 so as to rotationally drive the rotor shaft 113 via an electromagnetic force acting between the magnetic pole and the rotor shaft 113. In addition, a rotational speed sensor such as, e.g., a Hall element, a resolver, or an encoder which is not shown is incorporated into the motor 121, and a rotational speed of the rotor shaft 113 is detected by a detection signal of the rotational speed sensor.

Further, a phase sensor which is not shown is mounted in the vicinity of, e.g., the lower radial sensor 108, and is configured to detect a phase of rotation of the rotor shaft 113. The control device 200 is configured to detect a position of the magnetic pole by using detection signals of both of the phase sensor and the rotational speed sensor.

A plurality of stator blades 123 (123*a*, 123*b*, 123*c* . . . ) are provided so as to be slightly spaced from the rotor blades 102 (102*a*, 102*b*, 102*c* . . . ). Each of the rotor blades 102 (102*a*, 102*b*, 102*c* . . . ) transfers a molecule of exhaust gas downward by collision, and hence each of the rotor blades 102 is formed so as to be inclined from a plane perpendicular to an axis of the rotor shaft 113 by a predetermined angle. The stator blades 123 (123*a*, 123*b*, 123*c* . . . ) are constituted by a metal such as, e.g., aluminum, iron, stainless steel, or copper, or metals such as alloys containing these metals as ingredients.

In addition, similarly, each of the stator blades 123 is also formed so as to be inclined from the plane perpendicular to the axis of the rotor shaft 113 by a predetermined angle, and the stator blades 123 are disposed so as to extend toward an inner side of the outer tube 127 and alternate with tiers of the rotor blades 102. Further, outer peripheral ends of the stator blades 123 are supported in a state in which the outer peripheral ends thereof are inserted between a plurality of stator blade spacers 125 (125*a*, 125*b*, 125*c* . . . ) which are stacked on each other.

Each of the stator blade spacers 125 is a ring-shaped member, and is constituted by a metal such as, e.g., aluminum, iron, stainless steel, or copper, or metals such as alloys containing these metals as ingredients. Outer tubes 127 and 127*a* are fixed to outer peripheries of the stator blade spacers 125 so as to be slightly spaced from the outer peripheries thereof. A base portion 129 is disposed at a bottom portion of the outer tube 127*a*. In addition, an outlet port 133 is disposed above the base portion 129, and is caused to communicate with the outside. Exhaust gas which has entered the inlet port 101 from a side of a chamber (vacuum chamber) and has been transferred is sent to the outlet port 133.

Further, depending on usage of the turbo-molecular pump 100, a threaded spacer 131 is disposed between a portion below the stator blade spacer 125 and the base portion 129. The threaded spacer 131 is a cylindrical member constituted by metals such as aluminum, copper, stainless steel, iron, or alloys containing these metals as ingredients, and a spiral thread groove 131*a* having a plurality of threads is formed in an inner peripheral surface of the threaded spacer 131. A direction of the spiral of the thread groove 131*a* is a direction in which, when the molecule of the exhaust gas moves in a rotation direction of the rotating body 103, this molecule is transferred toward the outlet port 133. At the lowest portion of the rotating body 103 subsequent to the rotor blades 102 (102*a*, 102*b*, 102*c* . . . ), a cylindrical portion 102*d* is disposed so as to extend downward. An outer peripheral surface of the cylindrical portion 102*d* is cylindrical, is protruded toward the inner peripheral surface of the threaded spacer 131, and is disposed close to the inner peripheral surface of the threaded spacer 131 with a predetermined gap formed between the outer peripheral surface thereof and the inner peripheral surface thereof. The exhaust gas having been transferred to the thread groove 131*a* by the rotor blades 102 and the stator blades 123 is sent to the base portion 129 while being guided by the thread groove 131*a*.

The base portion 129 is a disc-shaped member constituting a base bottom portion of the turbo-molecular pump 100 and, in general, the base portion 129 is constituted by a metal such as iron, aluminum, or stainless steel. The base portion 129 physically holds the turbo-molecular pump 100 and also has a function of a heat conductive path, and hence it is preferable to use a metal having rigidity of iron, aluminum, or copper and having high heat conductivity.

In such a configuration, when the rotor blade 102 is rotationally driven together with the rotor shaft 113 by the motor 121, the exhaust gas is sucked from the chamber through the inlet port 101 by actions of the rotor blade 102 and the stator blade 123. The rotational speed of the rotor blade 102 is usually 20000 rpm to 90000 rpm, and a circumferential velocity at a tip of the rotor blade 102 reaches 200 m/s to 400 m/s. The exhaust gas sucked from the inlet port 101 passes between the rotor blade 102 and the stator blade 123 and is transferred to the base portion 129. At this point, a temperature of the rotor blade 102 rises due to frictional heat generated when the exhaust gas comes into contact with the rotor blade 102 and conduction of heat generated in the motor 121, and this heat is transmitted to a side of the stator blade 123 by radiation or conduction by a gas molecule of the exhaust gas.

The stator blade spacers 125 are bonded to each other at their outer peripheral portions, and transmit heat received from the rotor blade 102 by the stator blade 123 and frictional heat generated when the exhaust gas comes into contact with the stator blade 123 to the outside.

Note that, in the foregoing, the description has been made on the assumption that the threaded spacer 131 is disposed on the outer periphery of the cylindrical portion 102*d* of the rotating body 103, and the thread groove 131*a* is formed in the inner peripheral surface of the threaded spacer 131. However, reversely to this, there are cases where the thread groove is formed in an outer peripheral surface of the cylindrical portion 102*d*, and a spacer having a cylindrical inner peripheral surface is disposed around the outer peripheral surface thereof.

In addition, depending on usage of the turbo-molecular pump 100, in order to prevent gas sucked from the inlet port 101 from entering an electrical component portion constituted by the upper radial electromagnet 104, the upper radial sensor 107, the motor 121, the lower radial electromagnet 105, the lower radial sensor 108, the axial electromagnets 106A and 106B, and the axial sensor 109, there are cases where a surrounding portion of the electrical component portion is covered with a stator column 122, and a pressure in the stator column 122 is maintained at a predetermined pressure by purge gas.

In these cases, piping which is not shown is disposed in the base portion 129, and the purge gas is introduced through the piping. The introduced purge gas is sent to the outlet port 133 through gaps between a protection bearing 120 and the rotor shaft 113, between a rotor and a stator of the motor 121, and between the stator column 122 and an inner peripheral side cylindrical portion of the rotor blade 102.

Herein, the turbo-molecular pump 100 uses a control based on identification of a model and inherent parameters which are adjusted individually (e.g., various characteristics corresponding to the model). For storing the control parameters, the above-described turbo-molecular pump 100 includes an electronic circuit portion 141 in a main body of the turbo-molecular pump 100. The electronic circuit portion 141 is constituted by electronic components such as a semiconductor memory such as an EEP-ROM and a semiconductor element for accessing the semiconductor memory, and a substrate 143 for implementing the electronic components. The electronic circuit portion 141 is housed in a lower portion of a rotational speed sensor which is not shown in the vicinity of, e.g., the center of the base portion 129 constituting a lower portion of the turbo-molecular pump 100, and the lower portion is closed by a hermetic bottom lid 145.

Incidentally, in a manufacturing process of a semiconductor, some process gases introduced into a chamber have properties which make the process gases solid when pressure of the process gases becomes higher than a predetermined value or temperature of the process gases becomes lower than a predetermined value. Inside the turbo-molecular pump 100, pressure of the exhaust gas is minimized at the inlet port 101 and is maximized at the outlet port 133. When the pressure of the process gas becomes higher than a predetermined value or the temperature thereof becomes lower than a predetermined value during transfer of the process gas from the inlet port 101 to the outlet port 133, the process gas becomes solid, and is adhered to and deposited on the inside of the turbo-molecular pump 100.

For example, in the case where $SiCl_4$ is used as a process gas in an Al etching device, it can be seen from a vapor pressure curve that a solid product (e.g., $AlCl_3$) is precipitated at a low degree of vacuum (760 [torr] to $10^{-2}$ [torr]) and at a low temperature (about 20 [° C.]) and the solid product is adhered to and deposited on the inside of the turbo-molecular pump 100. With this, when the precipitate of the process gas is deposited on the inside of the turbo-molecular pump 100, the deposit narrows a pump flow path and becomes a cause of a reduction in performance of the turbo-molecular pump 100. In addition, the above-described product is in a situation in which the product is easily coagulated and adhered in a portion in which pressure is high in the vicinity of the outlet port 133 or in the vicinity of the threaded spacer 131.

Accordingly, in order to solve this problem, conventionally, a heater which is not shown or an annular water cooled tube 149 is wound around an outer periphery of the base portion 129 or the like, a temperature sensor (e.g., a thermistor) which is not shown is embedded in, e.g., the base portion 129, and control of heating by the heater or cooling by the water cooled tube 149 is performed such that a temperature of the base portion 129 is maintained at a constant high temperature (set temperature) based on a signal of the temperature sensor (hereinafter referred to as TMS. TMS; Temperature Management System).

Next, with regard to the thus-configured turbo-molecular pump 100, a description will be given of the amplifier circuit 150 which performs excitation control on the upper radial electromagnets 104, the lower radial electromagnet 105, and the axial electromagnets 106A and 106B. FIG. 2 shows a circuit diagram of the amplifier circuit 150.

Figure 2:
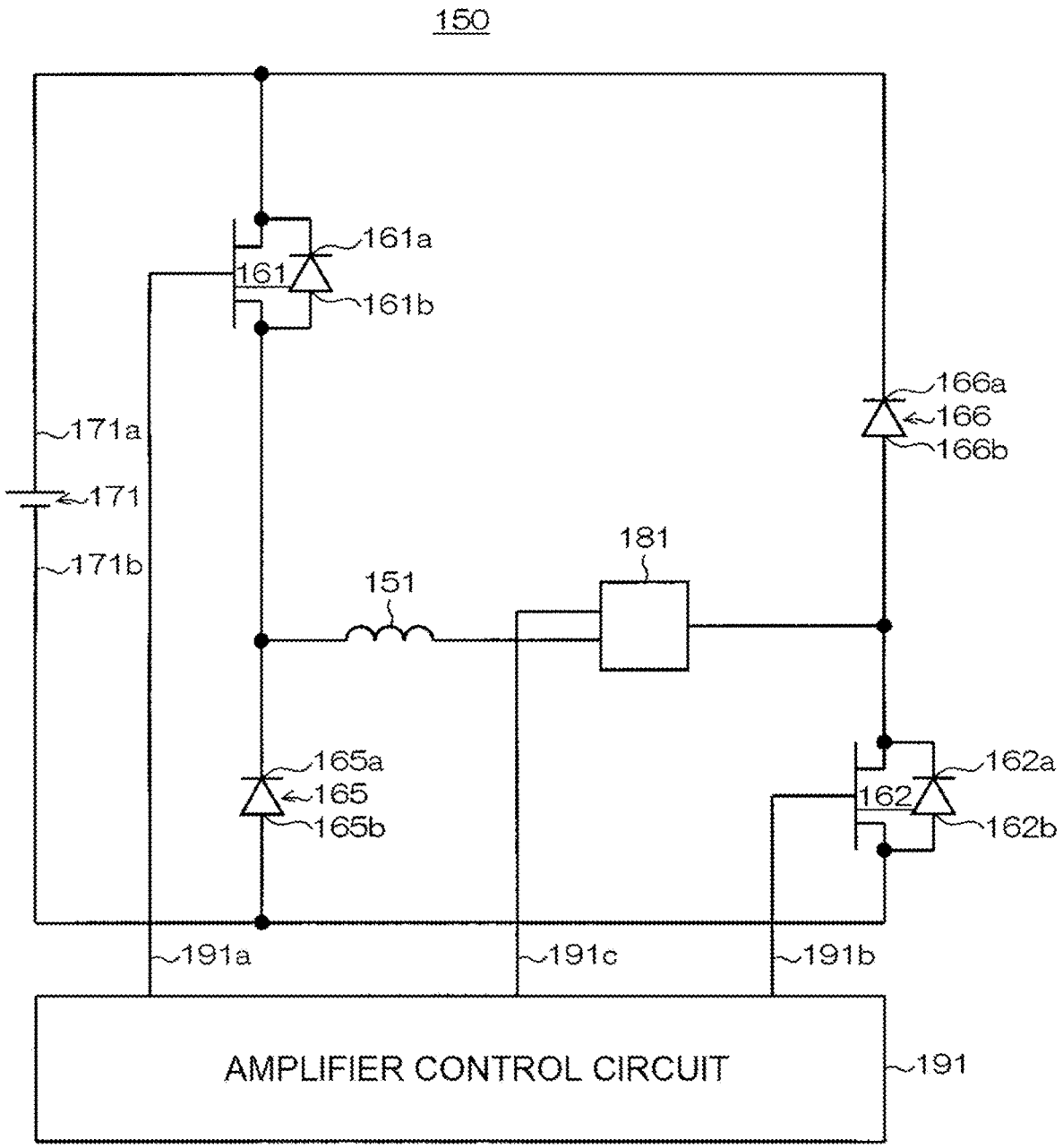
FIG. 2 is a circuit diagram showing an amplifier circuit which performs excitation control of an electromagnet of the turbo-molecular pump shown in FIG. 1.

In FIG. 2, one end of an electromagnet winding 151 constituting the upper radial electromagnet 104 or the like is connected to a positive electrode 171*a* of a power source 171 via a transistor 161, and the other end thereof is connected to a negative electrode 171*b* of the power source 171 via a current detection circuit 181 and a transistor 162. In addition, each of the transistors 161 and 162 is a so-called power MOSFET, and has a structure in which a diode is connected between a source and a drain.

At this point, in the transistor 161, a cathode terminal 161*a* of its diode is connected to the positive electrode 171*a*, and an anode terminal 161*b* is connected to the one end of the electromagnet winding 151. In addition, in the transistor 162, a cathode terminal 162*a* of its diode is connected to the current detection circuit 181, and an anode terminal 162*b* is connected to the negative electrode 171*b*.

On the other hand, in a diode for current regeneration 165, its cathode terminal 165*a* is connected to the one end of the electromagnet winding 151, and its anode terminal 165*b* is connected to the negative electrode 171*b*. In addition, similarly to this, in a diode for current regeneration 166, its cathode terminal 166*a* is connected to the positive electrode 171*a*, and its anode terminal 166*b* is connected to the other end of the electromagnet winding 151 via the current detection circuit 181. The current detection circuit 181 is constituted by, e.g., a Hall sensor-type current sensor and an electrical resistance element.

The thus-configured amplifier circuit 150 corresponds to one electromagnet. Accordingly, in the case where a magnetic bearing is a five-axis control magnetic bearing and the total number of electromagnets 104, 105, 106A, and 106B is ten, the same amplifier circuit 150 is configured for each of the electromagnets, and ten amplifier circuits 150 are connected in parallel to the power source 171.

Further, an amplifier control circuit 191 is constituted by, e.g., a digital signal processor portion (hereinafter referred to as a DSP portion) of the control device 200 which is not shown, and the amplifier control circuit 191 is configured to switch between on/off of the transistors 161 and 162.

The amplifier control circuit 191 is configured to compare a current value (a signal in which this current value is reflected is referred to as a current detection signal 191*c*) detected by the current detection circuit 181 with a predetermined current command value. Subsequently, the amplifier control circuit 191 is configured to determine magnitudes of a pulse width (pulse width time periods Tp1 and Tp2) generated in a control cycle Ts which is one cycle by PWM control based on a comparison result. As a result, gate drive signals 191*a* and 191*b* each having this pulse width are output to gate terminals of the transistors 161 and 162 from the amplifier control circuit 191.

Note that, at the time of passage of a resonance point during acceleration operation of the rotational speed of the rotating body 103 or at the time of occurrence of disturbance during constant speed operation, it may be desirable to perform position control of the rotating body 103 at high speed with a strong force. To cope with this, a high voltage of about, e.g., 50 V is used as the power source 171 such that a sharp increase (or decrease) of a current flowing to the electromagnet winding 151 is allowed. In addition, a capacitor (depiction is omitted) is usually connected between the positive electrode 171*a* and the negative electrode 171*b* of the power source 171 for stabilization of the power source 171.

In such a configuration, a current flowing to the electromagnet winding 151 (hereinafter referred to as an electromagnet current iL) is increased when both of the transistors 161 and 162 are turned on, and the electromagnet current iL is decreased when both thereof are turned off.

In addition, when one of the transistors 161 and 162 is turned on and the other one thereof is turned off, a so-called flywheel current is maintained. By flowing the flywheel current to the amplifier circuit 150 in this manner, it is possible to reduce hysteresis loss in the amplifier circuit 150 and suppress power consumption in the entire circuit to a low level. In addition, by controlling the transistors 161 and 162 in this manner, it is possible to reduce high frequency noise such as harmonics generated in the turbo-molecular pump 100. Further, by measuring the flywheel current in the current detection circuit 181, it becomes possible to detect the electromagnet current iL flowing in the electromagnet winding 151.

Figure 3:
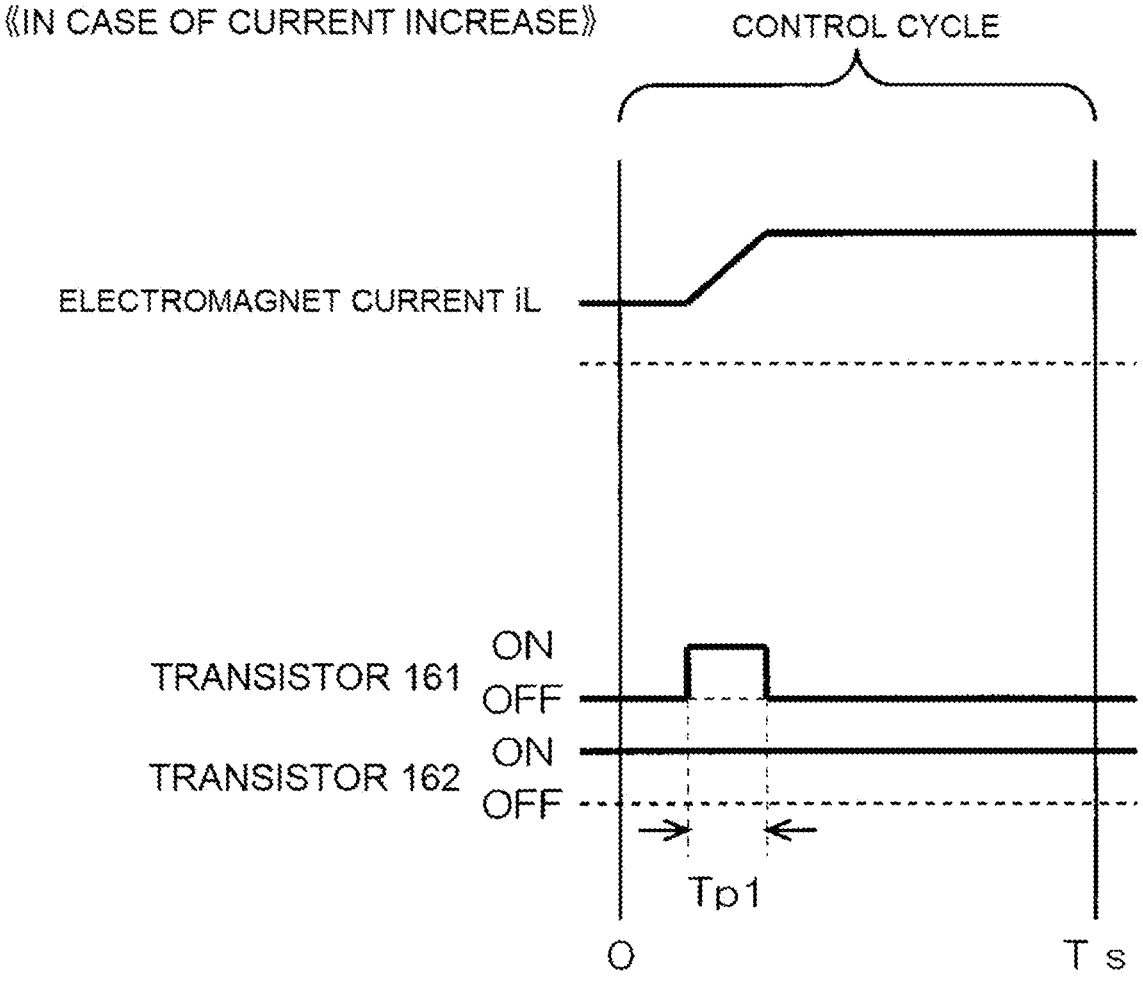
FIG. 3 is a time chart showing control in the case where a current command value is larger than a detection value.

That is, in the case where a detected current value is smaller than a current command value, as shown in FIG. 3, both of the transistors 161 and 162 are turned on only once in the control cycle Ts (e.g., 100 μs) for a time period corresponding to the pulse width time period Tp1. Consequently, the electromagnet current iL during this time period is increased toward a current value iLmax (not shown) which can be flowed from the positive electrode 171*a* to the negative electrode 171*b* via the transistors 161 and 162.

Figure 4:
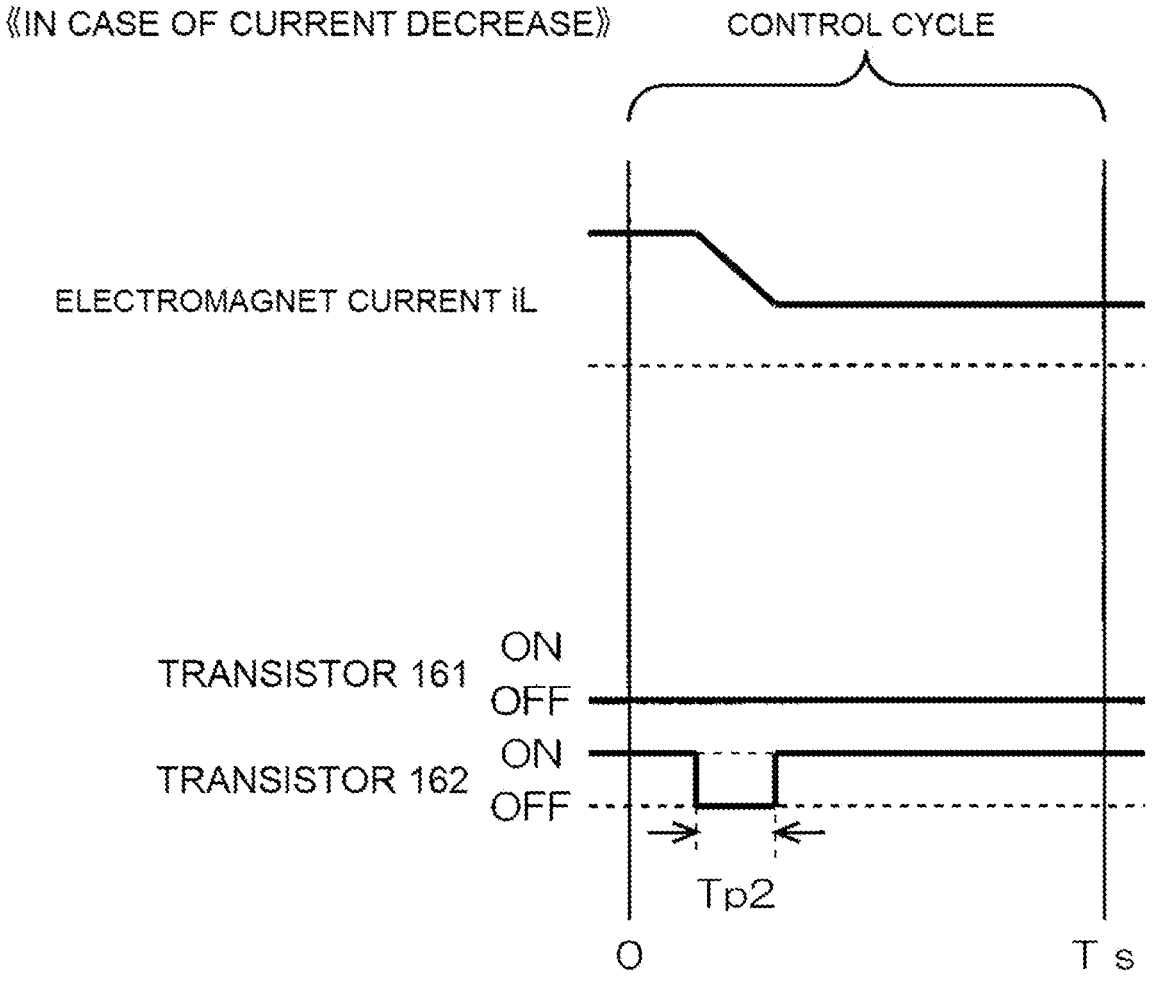
FIG. 4 is a time chart showing control in the case where the current command value is smaller than the detection value.

On the other hand, in the case where the detected current value is larger than the current command value, as shown in FIG. 4, both of the transistors 161 and 162 are turned off only once in the control cycle Ts for a time period corresponding to the pulse width time period Tp2. Consequently, the electromagnet current iL during this time period is decreased toward a current value iLmin (not shown) which can be regenerated from the negative electrode 171*b* to the positive electrode 171*a* via the diodes 165 and 166.

In either case, after a lapse of the pulse width time period Tp1 or Tp2, one of the transistors 161 and 162 is turned on. Accordingly, during this time period, the flywheel current is maintained in the amplifier circuit 150.

The turbo-molecular pump 100 is configured in the manner described above. The turbo-molecular pump 100 is an example of a vacuum pump. Further, in FIG. 1, the rotor blade 102 and the rotating body 103 are rotors of the turbo-molecular pump 100, the stator blade 123 and the stator blade spacer 125 are stators of a turbo-molecular pump portion, and the threaded spacer 131 is a stator of a thread groove pump portion subsequent to the turbo-molecular pump portion. In addition, the outer tube 127 and the outer tube 127*a* are casings of the turbo-molecular pump 100, and house the rotors and stators described above.

Further, in FIG. 1, a temperature rise ring 301 is an annular member which raises a temperature of a gas flow path by heat generation of a heater 302, and is constituted by the same material as that of the above-described stator. The temperature rise ring 301 and the heater 302 are also used in the above-described TMS.

The temperature rise ring 301 is fixed to the above-described stator so as to be able to transmit heat to the above-described stator, and is fixed to the outer tube 127*a* with a bolt or the like at its upper end. The temperature rise ring 301 is spaced from the base portion 129, a gap 303 is formed between the temperature rise ring 301 and the base portion 129, and the temperature rise ring 301 and the base portion 129 are insulated from each other by the gap 303. In addition, a sealing 304 is provided in the gap 303. Thus, the temperature rise ring 301 is not fixed directly to the base portion 129. Similarly, the threaded spacer 131 is not fixed directly to the base portion 129. Further, the outlet port 133 is fixed to the temperature rise ring 301, and external piping which is not shown is connected to the outlet port 133. Gas is transferred to the outlet port 133 via the gas flow path between the temperature rise ring 301 and the threaded spacer 131, and is exhausted to the external piping via the outlet port 133. Note that the outlet port 133 serves as the gas flow path and a temperature of the outlet port 133 is managed similarly, and hence the outlet port 133 is not fixed directly to the casing (outer tube 127*a*) and the base portion 129.

Figure 5:
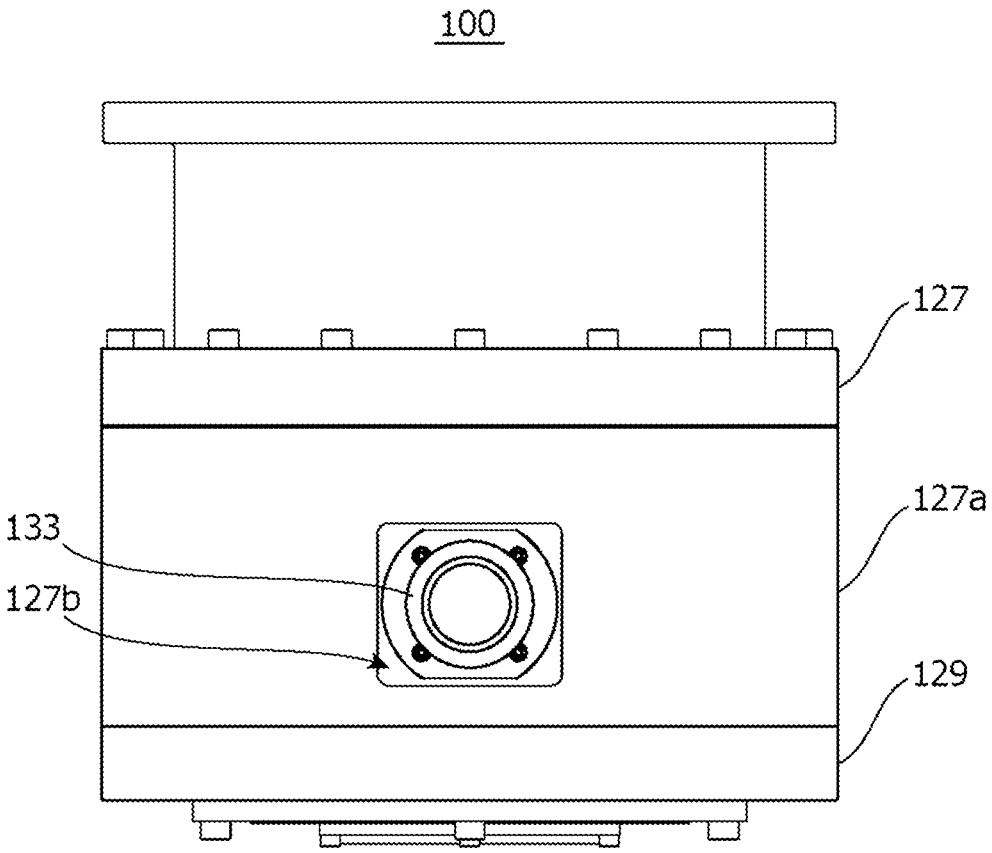
FIG. 5 is a side view showing the turbo-molecular pump serving as the vacuum pump according to Example 1 of the present disclosure.

FIG. 5 is a side view showing the turbo-molecular pump 100 serving as the vacuum pump according to Example 1 of the present disclosure. As shown in FIG. 5, the outlet port 133 is disposed to be inserted into an insertion hole 127*b* formed in the outer tube 127*a*, and the insertion hole 127*b* has a size larger than that of the outlet port 133 such that the outlet port 133 does not come into contact with the outer tube 127*a* in consideration of heat insulating properties to the casing and workability when the pump 100 is assembled.

As described above, while the occurrence of the deposit on the gas flow path is suppressed by the TMS, when a failure in which the above-described rotor comes into contact with the above-described stator occurs due to the deposit on the gas flow path or the like, a rotational force by rotation of the rotor is applied to the stator. At this point, the rotational force is also applied to the temperature rise ring 301 fixed to the stator. While the temperature rise ring 301 is indirectly fixed to the base portion 129 via the outer tube 127*a*, connection between the outer tube 127*a* and the temperature rise ring 301 is performed by a bolt or the like which is disposed in parallel to an axial direction of the pump 100 and it is difficult to use a relatively large bolt having high strength from the viewpoint of placement space, and hence there is a possibility that strength may become insufficient for the rotational force applied to the temperature rise ring 301 at the time of the above-described failure. In the case where the strength of the connection portion is insufficient for the rotational force, the rotational force is also applied to the outlet port 133 fixed to the temperature rise ring 301, and there is a possibility that the above-described problem may occur.

To cope with this, in the pump 100, a rotation suppression means for suppressing the rotation of the temperature rise ring 301 with respect to the casing by the rotational force is provided. In this example, the rotation suppression means includes a rotation regulation portion which is formed in the temperature rise ring 301, and a rotation regulation member which is fixed to the casing and comes into contact with the rotation regulation portion by the rotational force.

Figure 6:
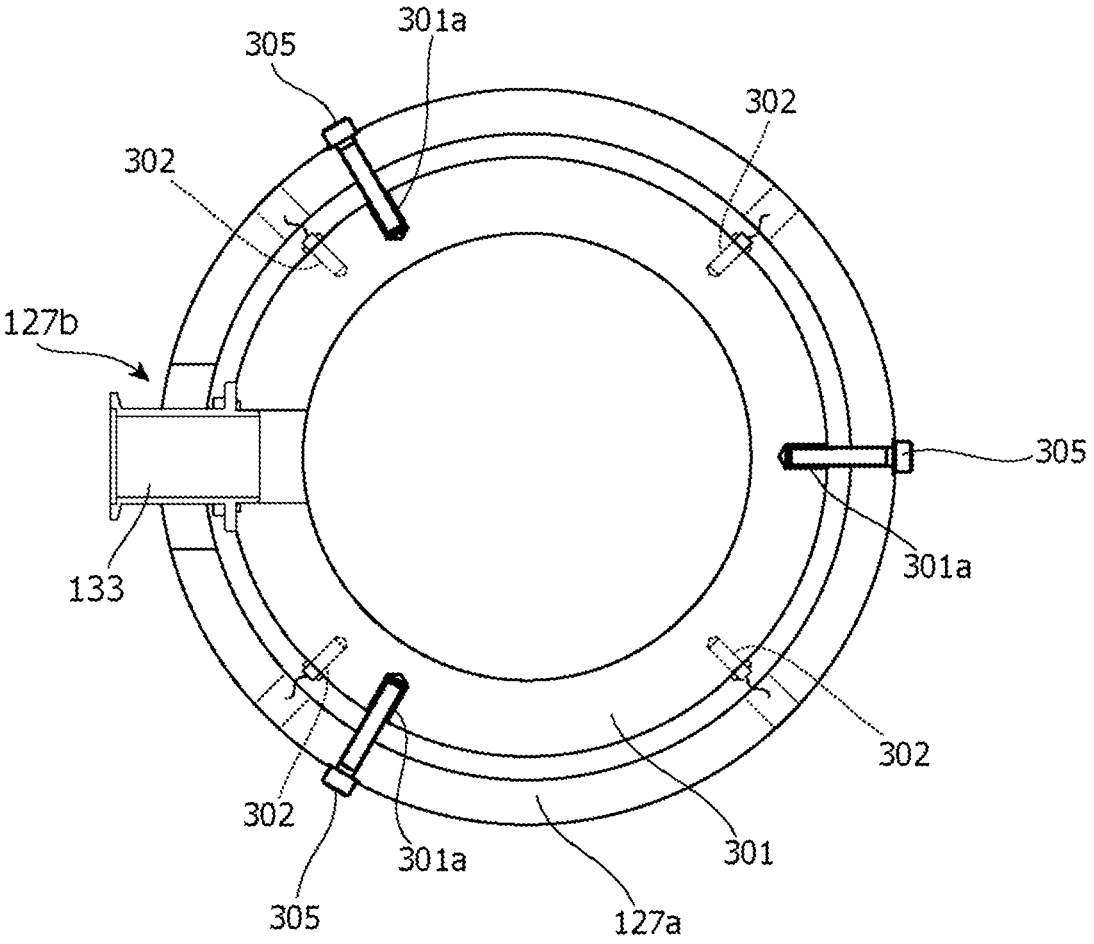
FIG. 6 is a transverse sectional view of the turbo-molecular pump shown in FIG. 1.

FIG. 6 is a transverse sectional view of the turbo-molecular pump shown in FIG. 1 (a view showing a cross section taken along the line A-A in FIG. 1). In this example, as shown in FIG. 1 and FIG. 6, the rotation regulation portion of the temperature rise ring 301 is a hole 301*a* extending along a radial direction of the pump 100, and the rotation regulation member is a bolt 305 disposed in the hole 301*a*. Specifically, a hole corresponding to the hole 301*a* is formed in the outer tube 127*a*, the bolt 305 is fixed to the hole of the outer tube 127*a* by screw connection, and a tip of the bolt 305 is disposed in the hole 301*a*. Note that a pin may also be used instead of the bolt 305. The hole 301*a* does not pass through the temperature rise ring 301. Note that, herein, the hole 301*a* and the bolt 305 are provided along the radial direction, but the hole 301*a* and the bolt 305 do not need to be provided along the radial direction.

In this example, the bolt 305 or the pin serving as the rotation regulation member can be installed from the outside of the casing after the rotor and the stator are housed inside the casing (outer tube 127*a*).

When the contact failure of the rotor described above is not present, a gap is present between the hole 301*a* and the bolt 305. Insulation between the temperature rise ring 301 and the casing (outer tube 127*a*) is secured by the gap.

In this example, for example, as shown in FIG. 6, a plurality of the holes 301*a* and a plurality of the bolts 305 are provided at equal angular intervals. Note that the number of the holes 301*a*, the number of the bolts 305, and a diameter and a material of the bolt 305 are selected based on strength to cope with the rotational force at the time of the contact failure described above. That is, the number of the holes 301*a*, the number of the bolts 305, and the diameter and the material of the bolt 305 are selected while connection strength between the temperature rise ring 301 and the outer tube 127*a* described above is considered such that there is obtained strength which substantially prevents occurrence of the rotation of the temperature rise ring 301 of which an angle exceeds a rotation angle for the rotation regulation member to come into contact with the rotation regulation portion by the rotational force.

Next, an operation of the vacuum pump according to Example 1 will be described.

During normal operation, the motor 121 operates based on control by the control device 200, and the rotor rotates. With this, gas flowed in via the inlet port 101 is transferred along the gas flow path between the rotor and the stator, and is exhausted to the external piping from the outlet port 133.

When a failure in which the rotor during rotation comes into contact with the stator occurs, the rotational force is applied to the stator by the contact of the rotor, and hence the rotational force is also applied to the temperature rise ring 301. At this point, with contact between the hole 301*a* and the bolt 305, the rotation of the temperature rise ring 301 is regulated and, eventually, the rotation of the outlet port 133 connected to the temperature rise ring 301 is suppressed. Accordingly, even when such a failure occurs, mechanical load applied to the external piping connected to the outlet port 133 is suppressed.

Thus, according to the example described above, the outlet port 133 to which the external piping is connected is connected to the temperature rise ring 301, and the rotational force is directly or indirectly applied to the temperature rise ring 301 due to the contact failure of the rotor during the rotation of the rotor. In addition, the rotation suppression means (the hole 301*a* and the bolt 305) for suppressing the rotation of the temperature rise ring 301 by the rotational force described above is provided separately from a connection portion (direct connection portion or indirect connection portion via another member) between the temperature rise ring 301 and the casing (outer tube 127*a*).

With this, an influence on the external piping caused by the contact of the rotor with a stator member (the stator or the like) during the rotation of the rotor is suppressed.

In the case where the above-described rotation suppression means is not provided and the temperature rise ring 301 and the outlet port 133 rotate (in a circumferential direction of the pump 100) at the time of occurrence of the failure described above, the outlet port 133 rotates until the outlet port 133 comes into contact with an inner wall of the insertion hole 127*b* of the outer tube 127*a*, and there is a possibility that large mechanical load may be applied to the external piping. On the other hand, the rotation of the temperature rise ring 301 is suppressed by the above-described rotation suppression means, whereby the rotation of the outlet port 133 is suppressed, and the mechanical load applied to the external piping connected to the outlet port 133 is suppressed.

In a vacuum pump according to Example 2 of the present disclosure, there is provided a rotation suppression means for suppressing the rotation of the temperature rise ring 301 by the above-described rotational force with respect to the base portion 129 to which the casing (outer tube 127*a*) is fixed. In Example 2, the rotation suppression means includes a rotation regulation portion which is formed in the temperature rise ring 301, and a rotation regulation member which protrudes from the base portion 129 in the axial direction, and comes into contact with the rotation regulation portion by its rotational force.

Figure 7:
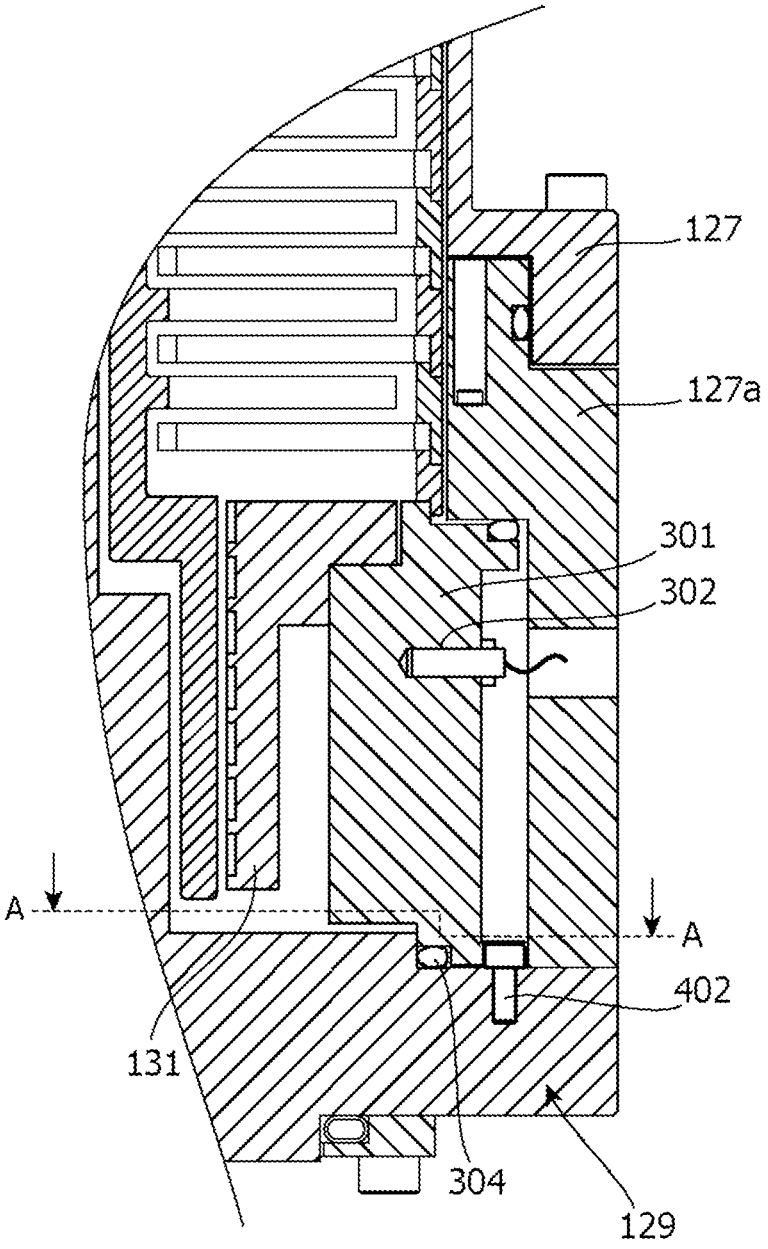
FIG. 7 is a longitudinal sectional view showing a turbo-molecular pump 100 serving as a vacuum pump according to Example 2 of the present disclosure.
Figure 8:
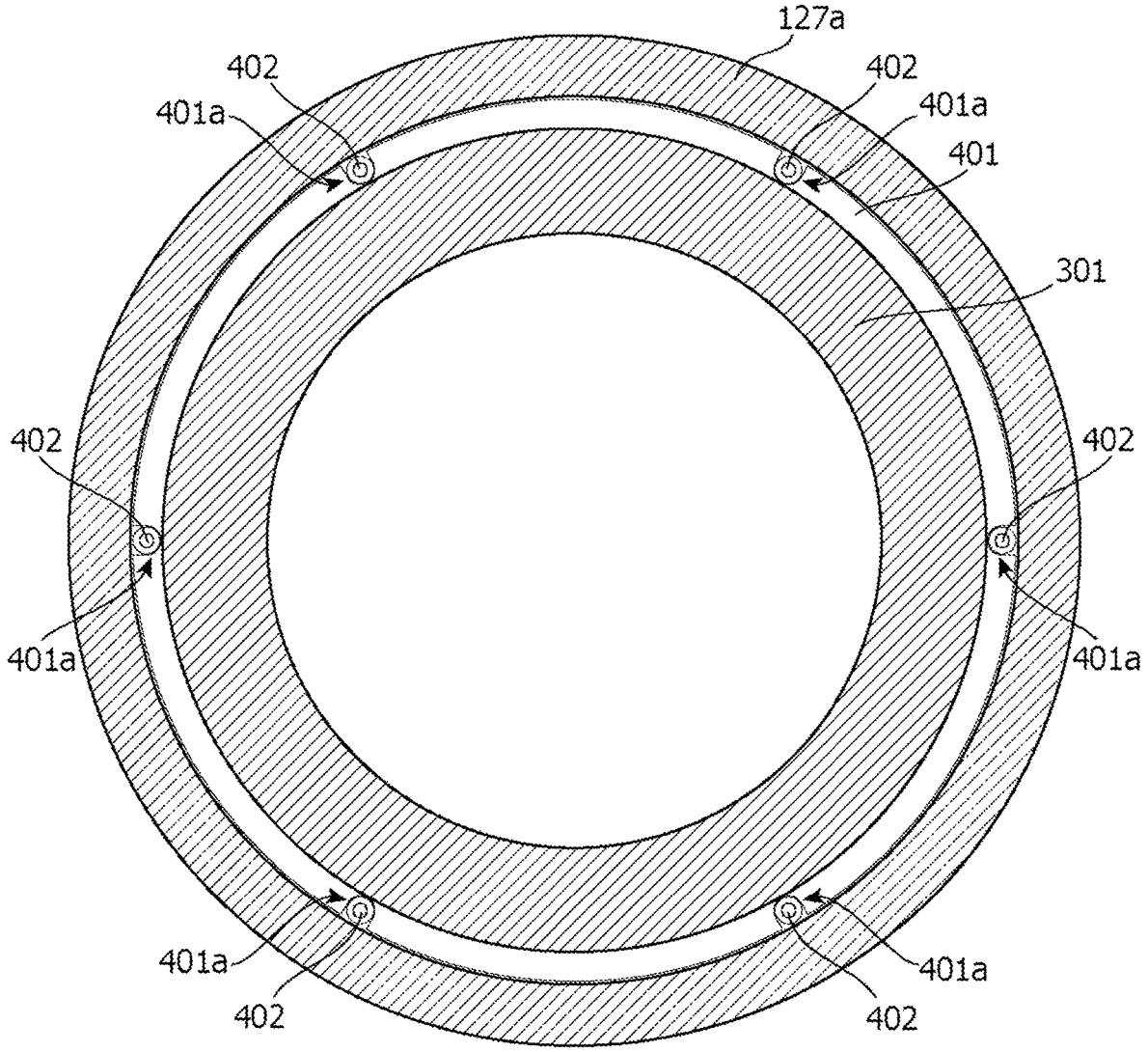
FIG. 8 is a transverse sectional view of the turbo-molecular pump shown in FIG. 7.
Figure 9:
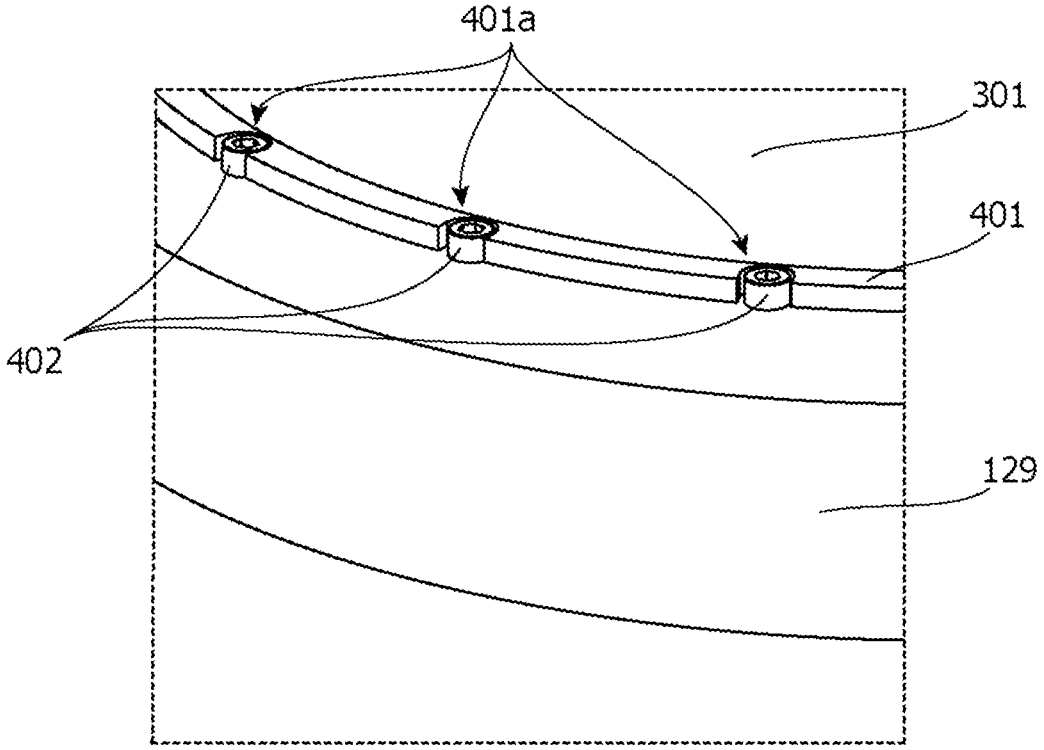
FIG. 9 is a perspective view showing an example of a rotation suppression means in Example 2.

FIG. 7 is a longitudinal sectional view showing the turbo-molecular pump 100 serving as the vacuum pump according to Example 2 of the present disclosure. FIG. 8 is a transverse sectional view of the turbo-molecular pump shown in FIG. 7 (a view showing a cross section taken along the line A-A in FIG. 7). FIG. 9 is a perspective view showing an example of the rotation suppression means in Example 2.

In Example 2, as shown in FIG. 7, FIG. 8, and FIG. 9, the rotation regulation portion of the temperature rise ring 301 is a notch 401*a* which is formed in a flange 401 of the temperature rise ring 301, and the rotation regulation member is a bolt 402 which is fixed to the base portion 129 along the axial direction. The bolt 402 is screw-connected to a female thread formed in a hole of the base portion 129, and its head portion is disposed in the notch 401*a*. Note that a pin may also be used instead of the bolt 402. In addition, a hole may also be provided instead of the notch 401*a*.

When the contact failure of the rotor described above is not present, a gap is present between the notch 401*a* (an inner wall surface thereof) and the bolt 402. In addition, a gap is also present between the flange 401 and the base portion 129. By these gaps, insulation between the temperature rise ring 301 and the base portion 129 is secured.

In this example, for example, as shown in FIG. 8 and FIG. 9, a plurality of the notches 401*a* and a plurality of the bolts 402 are provided at equal angular intervals. Note that the number of the notches 401*a*, the number of the bolts 402, and a diameter and a material of the bolt 402 are selected based on strength to cope with the rotational force at the time of the contact failure described above. That is, the number of the notches 401*a*, the number of the bolts 402, and the diameter and the material of the bolt 402 are selected such that there is obtained strength which substantially prevents the occurrence of the rotation of the temperature rise ring 301 of which an angle exceeds a rotation angle for the rotation regulation member to come into contact with the rotation regulation portion by the rotational force.

Next, an operation of the vacuum pump according to Example 2 will be described.

When a failure in which the rotor during rotation comes into contact with the stator occurs, the rotational force is applied to the stator by the contact of the rotor, and hence the rotational force is also applied to the temperature rise ring 301. At this point, with contact between the notch 401*a* and the bolt 402 of the temperature rise ring 301, the rotation of the temperature rise ring 301 is regulated and, eventually, the rotation of the outlet port 133 connected to the temperature rise ring 301 is suppressed. Accordingly, even when such a failure occurs, the mechanical load applied to the external piping connected to the outlet port 133 is suppressed.

Note that other configurations and operations of the vacuum pump according to Example 2 are the same as those of Example 1, and hence a description thereof will be omitted.

Note that various changes and modifications to the above-described examples are obvious to those skilled in the art. Such changes and modifications may be made without departing from the spirit and scope of the subject matter and without diminishing intended advantages. That is, it is intended that such changes and modifications are included in the scope of claims.

For example, in the examples described above, while the rotation regulation portion of the temperature rise ring 301 is the hole 301*a*, the rotation regulation portion may also be a groove or a notch facing the casing and, as another example, the rotation regulation portion may also be a protrusion or a stepped portion facing the casing.

In addition, in the examples described above, the temperature rise ring 301 to which the rotational force is indirectly applied is provided as the annular member to which the rotational force is directly or indirectly applied due to the contact failure of the rotor during the rotation of the rotor, and the above-described rotation suppression means is provided in the temperature rise ring 301 but, instead, the above-described rotation suppression means may also be provided in an annular member which does not require temperature management. Further, the above-described rotation suppression means may also be provided in an annular member connected to a piping connection portion for another external piping which is separate from the outlet port 133. Note that, in the case where the annular member is a member which does not require the temperature management, the gap between the rotation regulation portion and the rotation regulation member described above does not particularly need to be provided.

Further, in the examples described above, the annular member such as the temperature rise ring 301 may be one member, and may also be a member constituted by coupling a plurality of members to each other.

Further, in the examples described above, the bolt 105 or the pin may be disposed along the circumferential direction as described above, and may also be disposed in the axial direction.

Further, in the examples described above, a configuration may also be adopted in which, instead of the bolt 305 serving as the above-described rotation regulation member, a protrusion or a stepped portion facing the temperature rise ring 301 is provided in the casing, a gap is provided between the protrusion or the stepped portion of the casing and the temperature rise ring 301 when the above-described contact failure is not present, and the rotation of the temperature rise ring 301 by the rotational force caused by the above-described contact failure is suppressed. In addition, in the case where the above-described rotation regulation member such as the bolt 305 is not provided as another member which is separate from the casing and the protrusion or the stepped portion is provided in the casing, a gap is provided between the rotation regulation portion of the temperature rise ring 301 and the casing.

Further, in the examples described above, the temperature rise ring 301 and the threaded spacer 131 may also be integrated into one member. That is, the threaded spacer 131 may have a shape including the temperature rise ring 301 and may be used as the above-described annular member.

The present disclosure can be applied to the vacuum pump such as, e.g., the turbo-molecular pump.

The invention claimed is:

1. A vacuum pump comprising:

a rotor;

a stator;

a casing which houses the rotor and the stator, the casing including a first hole;

a base portion disposed at a bottom portion of the casing;

an annular member to which a rotational force of the rotor is directly or indirectly applied when the rotor contacts the annular member during rotation of the rotor, the annular member including a second hole;

a piping connection portion which is connected to the annular member and to which external piping is connected;

a fixing bolt provided along an axial direction of the vacuum pump and for fixing the casing and the annular member; and a rotation suppression means including a rotation suppression bolt disposed in the second hole, the rotation suppression means being for suppressing rotation of the annular member by the rotational force separately from a connection portion between the annular member and the casing, wherein:

the annular member is not fixed directly to the base portion, the rotation suppression bolt disposed in the second hole is provided along a radial direction of the vacuum pump, the rotation suppression bolt is fixed to the first hole by screw connection, when the rotor contacts the annular member, the rotation suppression bolt disposed in the second hole contacts with an inner surface of the second hole, and when the rotor does not contact the annular member, a gap is provided between the rotation suppression bolt disposed in the second hole and the inner surface of the second hole.

2. The vacuum pump according to claim 1, wherein:

the rotation suppression means includes a rotation regulation portion which is formed in the annular member and a rotation regulation member which is fixed to the casing and comes into contact with the rotation regulation portion by the rotational force.

3. The vacuum pump according to claim 2, wherein:

the annular member is a temperature rise ring which raises a temperature of a gas flow path by heat generation of a heater.

4. A vacuum pump comprising:

a rotor;

a stator;

a casing which houses the rotor and the stator;

an annular member to which a rotational force of the rotor is directly or indirectly applied when the rotor contacts the annular member during rotation of the rotor;

a piping connection portion which is connected to the annular member and to which external piping is connected;

a rotation suppression means for suppressing rotation of the annular member by the rotational force separately from a connection portion between the annular member and the casing; and a base portion disposed at a bottom portion of the casing, the base portion including a first hole, wherein:

the rotation suppression means includes a rotation regulation portion which is formed in the annular member and a rotation regulation member which protrudes in an axial direction from the base portion and comes into contact with the rotation regulation portion by the rotational force, the annular member includes a flange and a second hole or a notch formed in the flange, the rotation regulation portion is the second hole or the notch, the rotation regulation member is a bolt fixed to the first hole of the base portion by screw connection along the axial direction, when rotor contacts the annular member, a portion of the bolt protruding from the base portion contacts with an inner surface of the second hole or the notch of the flange, and when the rotor does not contact the annular member, a gap is provided between the portion of the bolt protruding from the base portion and inner surface of the second hole or the notch of the flange.

5. The vacuum pump according to claim 1, wherein:

the annular member is a temperature rise ring which raises a temperature of a gas flow path by heat generation of a heater.

6. The vacuum pump according to claim 1, wherein the piping connection portion is an outlet port.

7. The vacuum pump according to claim 1, wherein the gap is a first gap, and wherein:

the annular member is spaced from the base portion such that a second gap is formed between the annular member and the base portion, and the second gap is provided with a sealing.

* * * * *